US005681446A

United States Patent [19]

Betts et al.

[11] Patent Number: 5,681,446

[45] Date of Patent: Oct. 28, 1997

[54] IMPURITY REMOVAL FOR SODIUM CHLORATE

[75] Inventors: James A. Betts, Grand Prairie; Tomasz J. Dluzniewski, Mississauga, both of Canada

[73] Assignee: Sterling Pulp Chemicals, Ltd., Islington

[21] Appl. No.: 520,858

[22] Filed: Aug. 30, 1995

[51] Int. Cl.[6] ..... C25B 1/26

[52] U.S. Cl. ..... 205/503; 423/166; 423/475; 423/555

[58] Field of Search ..... 205/503, 474, 205/496; 423/178, 184, 499.5, 555, 475

[56] References Cited

U.S. PATENT DOCUMENTS 5,063,041 11/1991 Wanngard ..... 423/476

5,350,495 9/1994 Eriksson ..... 205/503

*Primary Examiner*—John Niebling

*Assistant Examiner*—Brendan Mee

*Attorney, Agent, or Firm*—Sim & McBurney

[57] ABSTRACT

Control of sulfate and perchlorate impurity levels is provided in a procedure for manufacturing crystalline sodium chlorate by electrolyzing an aqueous solution of sodium chloride and crystallizing sodium chlorate from the resulting aqueous solution of sodium chlorate and sodium chloride. The mother liquor from the crystallization, or a portion thereof, is treated simultaneously with calcium chloride to remove sulfate ions by precipitating calcium sulfate and with potassium chloride to remove perchlorate ions by precipitating potassium perchlorate.

14 Claims, 1 Drawing Sheet

IMPURITY REMOVAL FOR SODIUM CHLORATE

FIELD OF THE INVENTION

The present invention relates to the electrolytic production of sodium chlorate, and, in particular, to the removal of impurities from such sodium chlorate.

BACKGROUND OF THE INVENTION

Sodium chlorate is a chemical used in the pulp and paper industry for the production of chlorine dioxide by on-site facilities, which then is used to bleach pulp. Sodium chlorate is produced commercially by electrolysis of aqueous sodium chloride solution in an undivided electrochemical cell, in accordance with the equation:

$$NaCl+3\ H_2O \rightarrow NaClO_3+3H_2$$

The reaction proceeds only partially to completion and sodium chlorate is obtained by selective crystallization from the aqueous solution of sodium chlorate and sodium chloride (termed "cell liquor") in the electrolysis process. The mother liquor from the crystallization is recycled, after addition of make-up sodium chloride, to the electrochemical cell.

A problem that arises with this procedure is the accumulation of impurities and by-products in the electrolyte. One such by-product is sodium perchlorate. The accumulation of sodium perchlorate decreases sodium chloride solubility which has a negative impact on the electrolytic cell and crystallizer efficiencies. It is generally believed that such perchlorate arises from anodic oxidation of chlorate in the electrolytic cell, by the reaction depicted by the equation:

$$ClO_3^- + H_2O \rightarrow ClO_4^- + 2H^+ + 2e^-$$

The reaction competes with anodic chloride oxidation to chlorate and is enhanced at low chloride and high chlorate concentrations.

It has previously been suggested to remove this impurity in the form of precipitated potassium perchlorate. As described in U.S. Pat. No. 5,063,041, a portion of electrolyte from the chlorate manufacturing process first is evaporated at an elevated temperature and/or at a reduced pressure to effect an up to four-fold reduction in liquid volume. The concentrated liquor then is cooled to a temperature from 30° C. to 0° C. and the resulting crystallized material comprising mainly sodium chlorate and sodium chloride is separated. Subsequently aqueous potassium chloride with a concentration of from 1.0 mole/l up to saturation is added to the cooled liquor to precipitate potassium perchlorate, which is separated from the mother liquor, which in turn is recycled to the chlorate manufacturing process. An experimental evaluation of the process described in U.S. Pat. No. 5,063,041 showed the precipitated and removed potassium perchlorate to contain significant amounts of potassium chlorate, sodium chlorate and sodium chloride, which represent losses from the process.

Another impurity which is cumbersome in the chlorate manufacturing process comprises sulfate ions originating mainly from the feedstocks supplied to said manufacturing process. Sulfate ions removal involves typically a well known precipitation of calcium sulfate.

The present invention proposes a simplified process for a combined removal of both perchlorate and sulfate impurity wherein the costly evaporation of the portion of the electrolyte from the chlorate manufacturing process can be avoided and at the same time the losses of chlorate and chloride ions are minimized.

The novel method of the present invention leads to a significant reduction of the chlorate manufacturing cost by permitting a simultaneous removal of both above-mentioned impurities in a single unit operation employing a standard sulfate removal equipment comprising, typically, a simple reactor/clarifier and a mud filter.

SUMMARY OF INVENTION

In accordance with the present invention, there is provided an improved procedure for a combined removal of perchlorate and sulfate ions from an electrochemical process for the production of sodium chlorate. In the present invention, the mother liquor from sodium chlorate crystallization is simultaneously treated with calcium chloride and potassium chloride to precipitate calcium sulfate and potassium perchlorate from the treated mother liquor.

The simultaneous addition of calcium chloride and potassium chloride to the mother liquor from the sodium chlorate crystallization enables sulfate and perchlorate impurities to be removed simultaneously from the mother liquor. While sulfate removal is routinely effected by precipitation by the addition of calcium chloride, perchlorate removal has not heretofore been proposed to be carried out simultaneously with sulfate removal. By carrying out these impurity-removal procedures simultaneously, an overall improved efficiency of operation is achieved and the losses experienced in the prior art procedure described above are minimized.

Accordingly, in one aspect of the present invention, there is provided an improvement in a method for the production of sodium chlorate, which comprises electrolyzing an aqueous solution of sodium chloride to form an aqueous solution of sodium chlorate and sodium chloride, crystallizing sodium chlorate from the aqueous solution of sodium chlorate and sodium chloride to form a mother liquor and sodium chlorate crystals, separating sodium chlorate crystals from the mother liquor, adding make-up sodium chloride solution to the mother liquor to form a feed solution, and recycling the feed solution to the electrolyzing step. The improvement comprises treating at least a portion of the mother liquor with calcium chloride and potassium chloride to precipitate calcium sulfate and potassium perchlorate from the treated portion of mother liquor, and separating the precipitated calcium sulfate and potassium perchlorate from the treated portion of mother liquor, and subsequently recycling the treated portion of mother liquor to the electrolyzing step.

The rate of perchlorate and sulfate removal is adjusted to match the rate of perchlorate formation in the undesired reaction occurring in the electrochemical cell and sulfate ions input rate with the feedstocks. Typically, removal efficiencies of above about 80% and up to about 20% for the sulfate and perchlorate removal processes, respectively, are sufficient to maintain the overall process in balance.

DESCRIPTION OF PREFERRED EMBODIMENT

Figure 1:
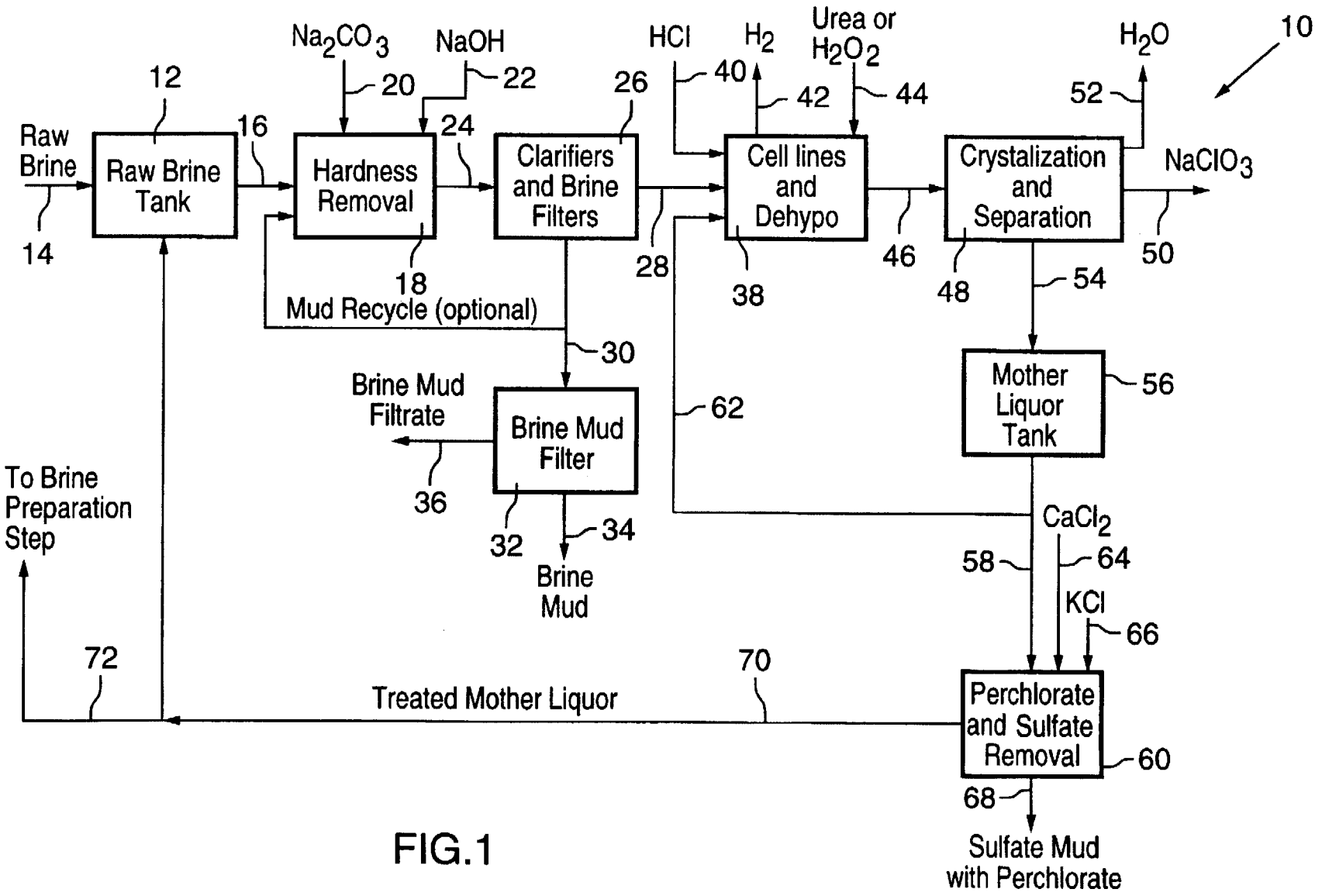
FIG. 1 is a block diagram flow sheet of a sodium chlorate production process in accordance with one embodiment of the invention.

A sodium chlorate production process 10 modified in accordance with the present invention is illustrated schematically in FIG. 1. The procedure involves initial brine (aqueous sodium chloride solution) preparation for electrolysis. Raw brine is fed to a raw brine tank 12 by the raw brine line 14. Raw brine from the raw brine tank 12 is fed by line 16 to a hardness removal equipment 18 to which aqueous sodium carbonate and aqueous sodium hydroxide are fed by lines 20 and 22 respectively. The resulting stream is forwarded by line 24 to brine clarifiers and filters 26, wherein suspended solids are removed as a slurry yielding a brine feed in line 28 suitable for the electrolytic procedure. The slurry from the clarifiers and brine filters 26 is directed by line 30 to a brine mud filter 32 on which brine mud is separated and removed by line 34. Optionally, a portion of the slurry from line 30 is redirected to the hardness removal equipment 18. Recovered brine from the brine mud filtration is recycled by line 36, preferably to the brine preparation step (not shown).

The brine feed in line 28 is passed to the cell lines 38 for electrolysis of the aqueous sodium chloride solution therein to form sodium chlorate. Hydrochloric acid is fed by line 40 to the cell lines 38 to control the pH of the electrolysis process. Hydrogen produced during the electrolysis process is vented from the cell lines 38 by line 42.

An aqueous solution of sodium chlorate and sodium chloride resulting from the electrolysis process is removed from the cell lines by line 46, usually after dehypoing treatment, for example, with urea or hydrogen peroxide fed by line 44. The dehypoed aqueous solution of sodium chlorate and sodium chloride is passed by line 46 to a crystallization and separation step 48 wherein the aqueous solution is concentrated by evaporation to precipitate crystalline sodium chlorate, which is removed by line 50. Water evaporated during the crystallization is removed by line 52.

The mother liquor from the crystallization step is forwarded by line 54 to a mother liquor tank 56. A portion of the mother liquor is forwarded by line 58 from the mother liquor tank 56 to a perchlorate and sulfate removal step 60 while the remaining portion of the mother liquor is recycled from the mother liquor tank 56 by line 62 to the cell lines 38.

In accordance with the present invention, calcium chloride is fed to the perchlorate and sulfate removal step 60 by line 64 while potassium chloride is fed to the step 60 by line 66. Alternatively, a mixed feed of potassium chloride and calcium chloride may be employed. The addition of the calcium chloride results in the precipitation of calcium sulfate, thereby removing sulfate from the system while the addition of the potassium chloride results in the precipitation of potassium perchlorate, thereby removing perchlorate from the system.

The combined perchlorate/sulfate removal process of the invention can be carried out under a variety of conditions. For example, the pH of the mother liquor being treated may vary over a wide range of about 5.5 to about 10, preferably from about 6 to about 9. Typically, no pH adjustment to the mother liquor is required prior to treatment.

Temperature of operation can be kept in a wide range of up to about 50° C., preferably from about 30° to about 40° C. Typically, no temperature adjustment to the mother liquor is required as the temperature of the mother liquor leaving the crystallizer generally falls within the preferred range. Excessive cooling of the mother liquor leaving the crystallizer generally should be avoided in order to minimize the post-crystallization of sodium chlorate and, possibly, potassium chlorate. It is possible to add a small amount of water to the mother liquor to prevent the aforementioned post-crystallization. Such water addition can be combined with the addition of potassium chloride and calcium chloride to effect precipitation of impurities.

Potassium chloride generally should be added in the amount to maintain a potassium ion concentration of about 5 to about 20 grams per liter, preferably about 10 to about 15 grams per liter, in the treated mother liquor at the outlet from the perchlorate/sulfate removal step (line 70). Calcium chloride generally should be added in an amount to maintain a concentration of about 0.5 to about 2 grams per liter (as $Ca^{++}$ ions) in the treated mother liquor at the outlet from the perchlorate/sulfate removal step (line 70).

Following precipitation of the mixture of calcium sulfate and potassium perchlorate, the precipitate is separated from the treated mother liquor and removed from tank 60 by line 68. The treated mother liquor then is recycled by line 70 back to the process, for example, to the raw brine tank 12, or, through line 72, to the brine preparation step (not shown).

SUMMARY OF DISCLOSURE

In summary of this disclosure, the present invention provides a novel procedure for removing impurities, specifically sulfate and perchlorate, from the electrolytic production of sodium chlorate, by simultaneous treatment of the mother liquor from the sodium chlorate crystallization step with calcium chloride and potassium chloride. Modifications are possible within the scope of this invention.

What we claim is:

1. In a process for the production of sodium chlorate, which comprises:

electrolyzing an aqueous solution of sodium chloride to form an aqueous solution of sodium chlorate and sodium chloride, crystallizing sodium chlorate from said aqueous solution of sodium chlorate and sodium chloride to form a mother liquor and sodium chlorate crystals, separating the sodium chlorate crystals from said mother liquor, adding make-up sodium chloride solution to said mother liquor to form a feed solution, and recycling the feed solution to said electrolyzing step, the improvement which comprises:

simultaneously treating at least a portion of said mother liquor with calcium chloride and potassium chloride to precipitate calcium sulfate and potassium perchlorate from the treated portion of mother liquor, separating said precipitated calcium sulfate and potassium perchlorate from the treated portion of mother liquor, and subsequently recycling the treated portion of mother liquor to said electrolyzing step.

2. The process of claim 1 wherein said calcium chloride and potassium chloride are employed in the form of separate aqueous solutions thereof added to said at least a portion of said mother liquor.

3. The process of claim 1 wherein said calcium chloride and potassium chloride are employed in the form of a single aqueous solution thereof added to said at least a portion of said mother liquor.

4. The process of claim 1 wherein the rate of perchlorate ion and sulfate ion removal from the mother liquor is adjusted to match the rate of perchlorate ion formation occurring in the electrolyzing step and the rate of sulfate ion input with said aqueous solution of sodium chloride.

5. The process of claim 1 wherein a portion only of said mother liquor is subjected to said treating, separating and recycling steps.

6. The process of claim 1 wherein said simultaneous treating step is effected at a pH of the at least a portion of the mother liquor of about 5.5 to about 10.

7. The process of claim 6 wherein said pH is about 6 to about 9.

8. The process of claim 1 wherein said simultaneous treating step is effected at a temperature of the at least a portion of the mother liquor of up to about 50° C.

9. The process of claim 8 wherein said temperature is about 30° to about 40° C.

10. The process of claim 1 wherein said simultaneous treating step is effected with an amount of potassium chloride sufficient to maintain a potassium ion concentration of about 5 to about 20 grams per liter in the treated portion of mother liquor.

11. The process of claim 10 wherein said amount of potassium chloride is sufficient to maintain a potassium ion concentration in the treated portion of mother liquor of about 10 to about 15 grams per liter.

12. The process of claim 1 wherein said simultaneous treating step is effected with an amount of calcium chloride sufficient to maintain a calcium ion concentration of about 0.5 to about 2 grams per liter in the treated portion of mother liquor.

13. The process of claim 1 wherein said simultaneous treating step is effected with an amount of potassium chloride sufficient to maintain a potassium ion concentration in the treated portion of mother liquor of about 10 to about 15 grams per liter and an amount of calcium chloride sufficient to maintain a calcium ion concentration of about 0.5 to about 2 grams per liter in the treated portion of mother liquor.

14. The process of claim 13 wherein a portion only of said mother liquor is subjected to said treating, separating and recycling steps and said simultaneous treating step is effected at a pH of the portion of the mother liquor of about 6 to about 9 and at a temperature of the portion of mother liquor of about 30° to about 40° C.

* * * * *